United States Patent [19]

Papallo, Jr. et al.

[11] Patent Number: 5,014,025

[45] Date of Patent: May 7, 1991

[54] ACTUATOR-ACCESSORY RESET ARRANGEMENT FOR MOLDED CASE CIRCUIT INTERRUPTER OR ELECTRIC SWITCH

[75] Inventors: Thomas F. Papallo, Jr., Plainville; Roger N. Castonguay, Terryville, both of Conn.

[73] Assignee: General Electric Company, New York, N.Y.

[21] Appl. No.: 518,672

[22] Filed: May 3, 1990

[51] Int. Cl.[5] ..... H01H 9/20

[52] U.S. Cl. ..... 335/167; 335/172; 335/22

[58] Field of Search ..... 335/8-9, 335/167-175, 189, 190, 21-23

[56] References Cited

U.S. PATENT DOCUMENTS

| | | | |
|---|---|---|---|
| 4,001,742 | 1/1977 | Jencks et al. | 335/173 |
| 4,123,734 | 10/1978 | Maier et al. | 335/22 |
| 4,344,054 | 8/1982 | Castonguay et al. | 335/169 |
| 4,658,323 | 4/1987 | Dougherty . | |
| 4,679,016 | 7/1987 | Ciarcia et al. . | |
| 4,698,903 | 10/1987 | Ciarcia et al. . | |
| 4,736,174 | 4/1988 | Castonguay et al. . | |
| 4,778,995 | 10/1988 | Kulpinski et al. . | |
| 4,833,563 | 5/1989 | Russell . | |
| 4,894,631 | 1/1990 | Castonguay et al. . | |
| 4,913,503 | 4/1990 | Castonguay et al. . | |

*Primary Examiner*—Leo P. Picard
*Assistant Examiner*—Lincoln Donovan
*Attorney, Agent, or Firm*—Richard A. Menelly; Walter C. Bernkopf; Fred Jacob

[57] ABSTRACT

An integrated protection unit is a circuit breaker which includes basic overcurrent protection facility along with selective electrical accessories. A molded plastic accessory access cover secured to the integrated protection unit cover protects the accessory components contained within the integrated protection unit cover from the environment. A combined overcurrent trip actuator and multiple accessory unit can be field-installed within the integrated protection unit. The combined actuator-accessory unit includes electronic control circuitry for the accessories along with mechanical trip and reset interface components. The reset mechanism allows the actuator-accessory unit to become reset without interfering with the operation of the integrated protection unit.

9 Claims, 5 Drawing Sheets

ACTUATOR-ACCESSORY RESET ARRANGEMENT FOR MOLDED CASE CIRCUIT INTERRUPTER OR ELECTRIC SWITCH

BACKGROUND OF THE INVENTION

The trend in the circuit protection industry is currently toward complete circuit protection which is accomplished by the addition of supplemental protection apparatus to standard overcurrent protective devices, such as molded case circuit breakers. In the past, when such auxiliary protection apparatus or other circuit breaker accessories were combined with a standard circuit breaker, the accessories were usually custom-installed at the point of manufacture. The combined protective device, when later installed in the field, could not be externally accessed for inspection, replacement or repair without destroying the integrity of the circuit breaker U.S. Pat. No. 4,894,631 describes a molded case circuit breaker containing an actuator-accessory unit which provides a wide variety of circuit protection accessory options. This patent is incorporated herein for purposes of reference and should be reviewed for its description of the state-of-the-art of such circuit breakers and accessory devices.

U.S. Pat. No. 4,913,503 describes a reset mechanism for a lower ampere-rated circuit interrupter usually employed as a "branch" circuit interrupter within industrial power distribution systems downstream from a higher-rated "main" circuit interrupter. When actuator-accessory units are used within the higher-rated circuits, the actuator-accessory units are incapable of providing sufficient force per se, to overcome the holding force of the powerful operating mechanism springs. Additional trip force is provided by a supplemental tripping mechanism which interacts with the actuator-accessory unit through a sequential resetting arrangement to insure that the actuator-accessory unit becomes reset before the main operating mechanism is reset.

One purpose of this invention is to describe such a sequential resetting system that interfaces between the tripping mechanism and the actuator-accessory unit of a higher-rated molded case circuit interrupter to insure that the actuator-accessory unit becomes reset before the main operating mechanism.

SUMMARY OF THE INVENTION

An integrated protection unit which includes overcurrent protection along with auxiliary accessory function within a common enclosure contains an accessory cover for access to the selected accessory components to allow field installation of the accessory components. A combined actuator-accessory unit provides overcurrent, shunt trip or undervoltage release functions and is arranged within one part of the enclosure. The circuit interrupter operating mechanism interfaces with a sequential resetting arrangement by means of a sequence drive lever rotatably connected with the operating mechanism cradle. A latch arrangement on the actuator-accessory unit only engages the operating mechanism trip cam when the actuator-accessory unit is reset to thereby allow the operating mechanism to become reset.

DESCRIPTION OF THE PREFERRED EMBODIMENT

Figure 1:
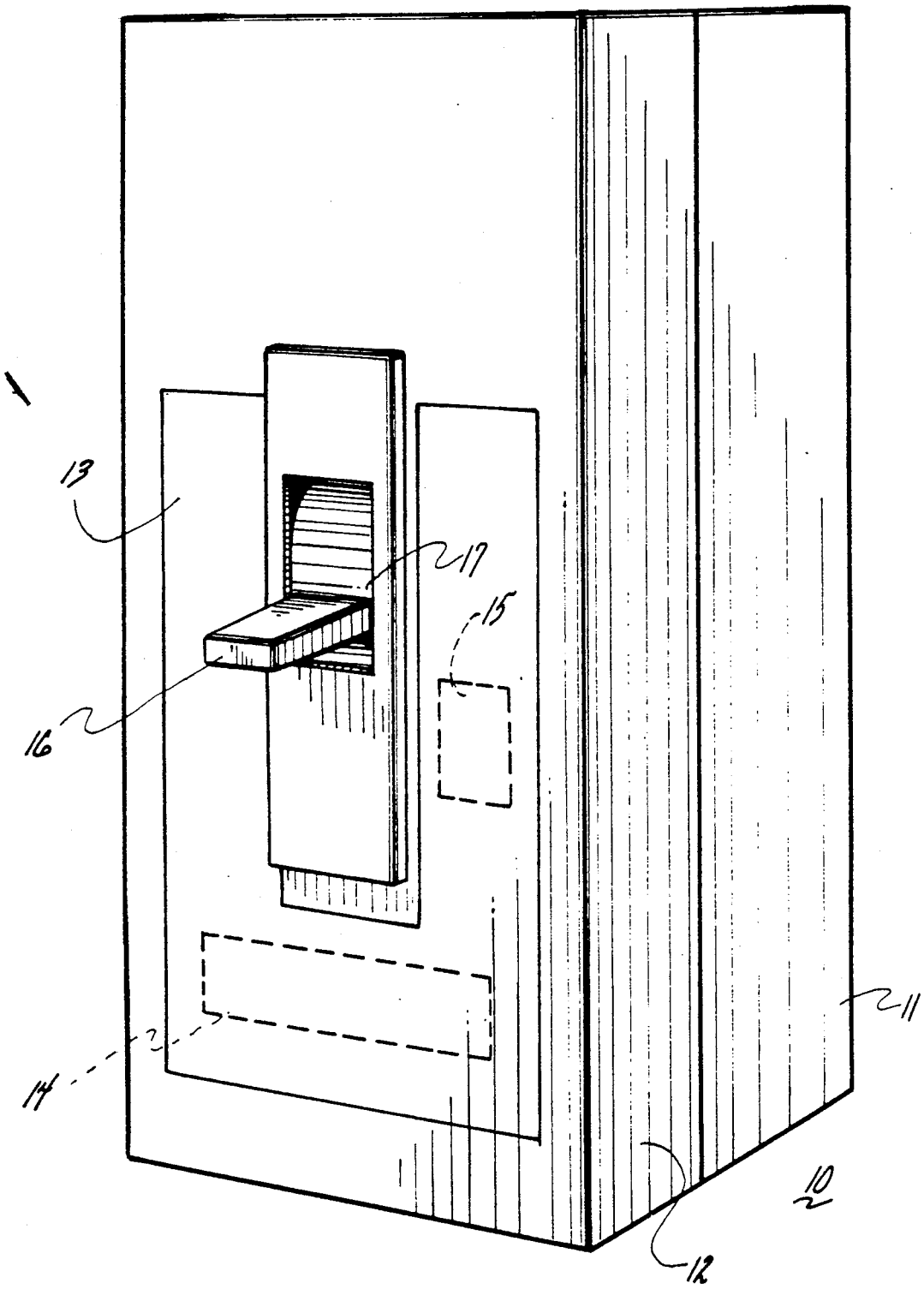
FIG. 1 is a top perspective view of a molded case circuit interrupter containing the sequential resetting arrangement in accordance with the invention.
Figure 2:
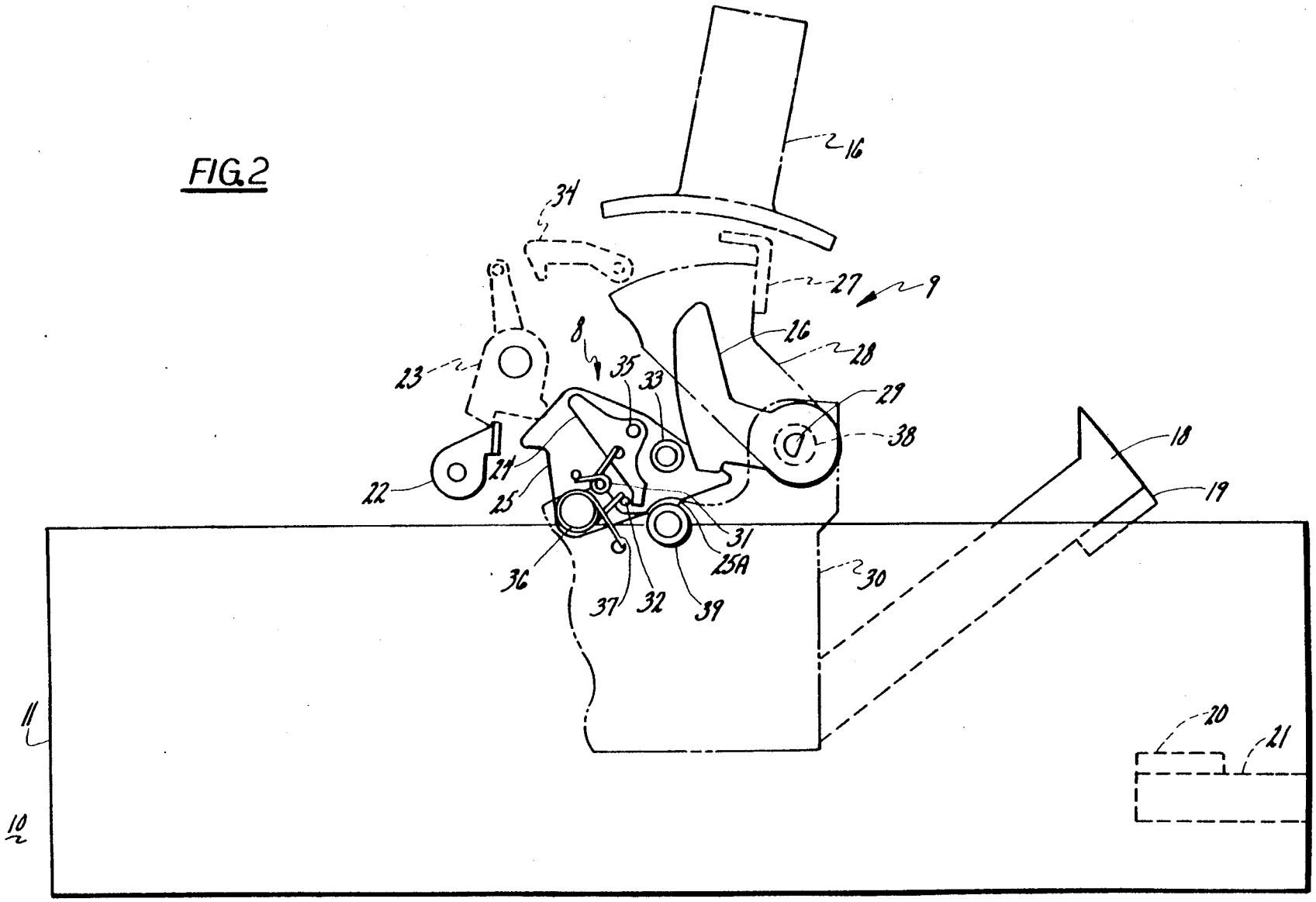
FIG. 2 is a cutaway side view of the circuit interrupter of FIG. 1 with the operating mechanism in a "TRIPPED" condition.

A higher-rated circuit interrupter 10, as described earlier, is depicted in FIG. 1 and consists of a molded plastic case 11 to which a molded plastic cover 12 is fixedly secured. An accessory cover 13 is attached to the circuit interrupter cover and provides access to an electronic trip unit 14 and an actuator-accessory unit 15. An operating handle 16 extends through the circuit interrupter cover by means of an access slot 17 and provides manual intervention to turn the circuit interrupter contacts 19, 20 between their open and closed positions as best seen by referring now to the followings FIGS. 2–5.

The contacts 19, 20 are depicted in the "TRIPPED" position of the circuit interrupter operating mechanism generally designated at 9 and which includes a cradle 28 for latching the movable contact arm 18 between its "CLOSED" and "OPEN" positions. In the TRIPPED position indicated in FIG. 2, the movable contact arm 18 and attached contact 19 are automatically driven away from the fixed contact 20 and fixed contact support 21 by articulation of the operating mechanism upon the occurrence of an overcurrent condition, by means of the electronic trip unit. A good description of one such electronic trip unit is found within U.S. Pat. No. 4,658,323 while a general description of a circuit breaker operating mechanism is found within U.S. Pat. No. 4,736,174 both Patents are incorporated herein for purposes of reference. A combined actuator-accessory module for interfacing between the operating mechanism and the electronic trip unit is described in U.S. Pat. No. 4,833,563 which Patent is also incorporated herein for reference purposes. The operating handle 16, cradle 28 and operating mechanism sideframe 30 are depicted in phantom for purposes of clarity. The cradle 28 is operatively attached to the mechanism sideframe by means of a cradle pivot pin 38 such as described in U.S. Pat. Nos. 4,679,016 and 4,698,903 which Patents are incorporated herein for reference purposes. In returning the circuit breaker operating mechanism and contacts to their operable CLOSED positions, the actuator-accessory latch 34 and trip cam 23 associated with the actuator-accessory unit 15 within the circuit breaker cover 12 shown earlier in FIG. 1, are depicted herein in phantom in order to show the interaction between the circuit breaker operating mechanism 9 and the sequential resetting arrangement 8 in accordance with the invention. The relationship between the circuit breaker operating mechanism and the sequential resetting system within the case 11 is controlled by means of a sequence driver 26 arranged on the end of the cradle pivot pin by means of a D-shaped slot 29. As the operating handle 16 and handle yoke 27 are moved sequentially counterclockwise to rotate the cradle 28 and reset the circuit breaker operating mechanism, the sequence driver 26 interacts with the sequential resetting system 8 by striking the drive roller 33 on the sequence lever 25 which in turn rotates the sequence lever about a pivot pin 36 driving one end of the reset bar 24 into contact with a projection on the trip cam 23, thereby rotating the trip cam out of abutment with the trip bar 22. The sequence lever 25 is attached to the sideframe by means of the pivot pin 36 and is biased to its rest position shown in FIG. 2 by means of a torsion spring 37. The reset bar 24 is biased to its rest position about a pivot pin 35 by means of a torsion spring 31 and a stop pin 32. An arcuate cut-out 25A on the sequence lever 25 abuts against a post 39 on the sideframe 30 to accurately return the sequence lever to the initial reset position indicated in FIG. 2 against the return bias of the torsion spring 37. The interaction between the trip bar 22, trip cam 23 and the accessory latch 34 during the reset function of the circuit interrupter operating mechanism is described within aforementioned U.S. Pat. No. 4,913,503.

Figure 3:
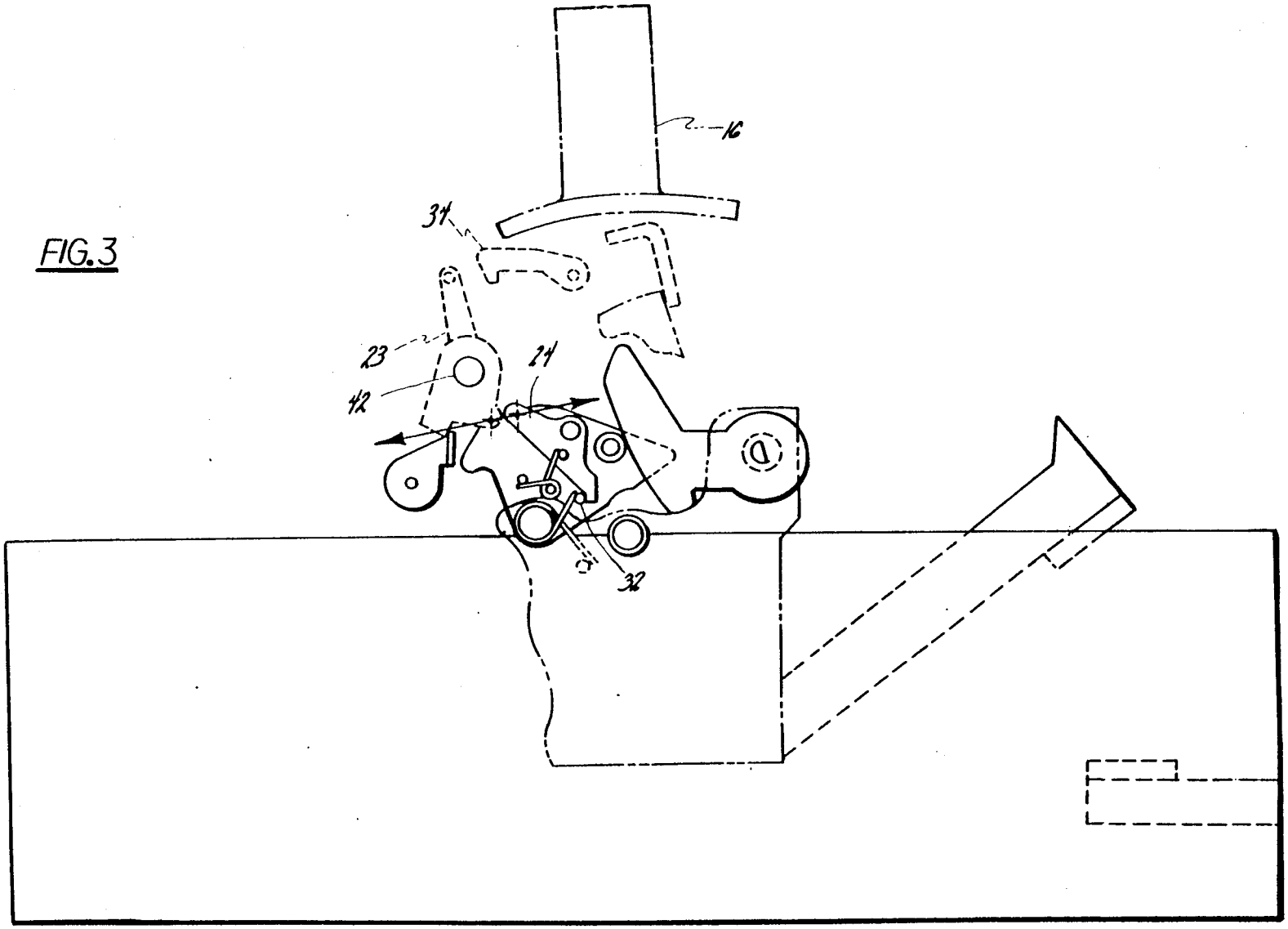
FIG. 3 is a cutaway side view of the circuit interrupter of FIG. 1 in the primary reset stage.
Figure 4:
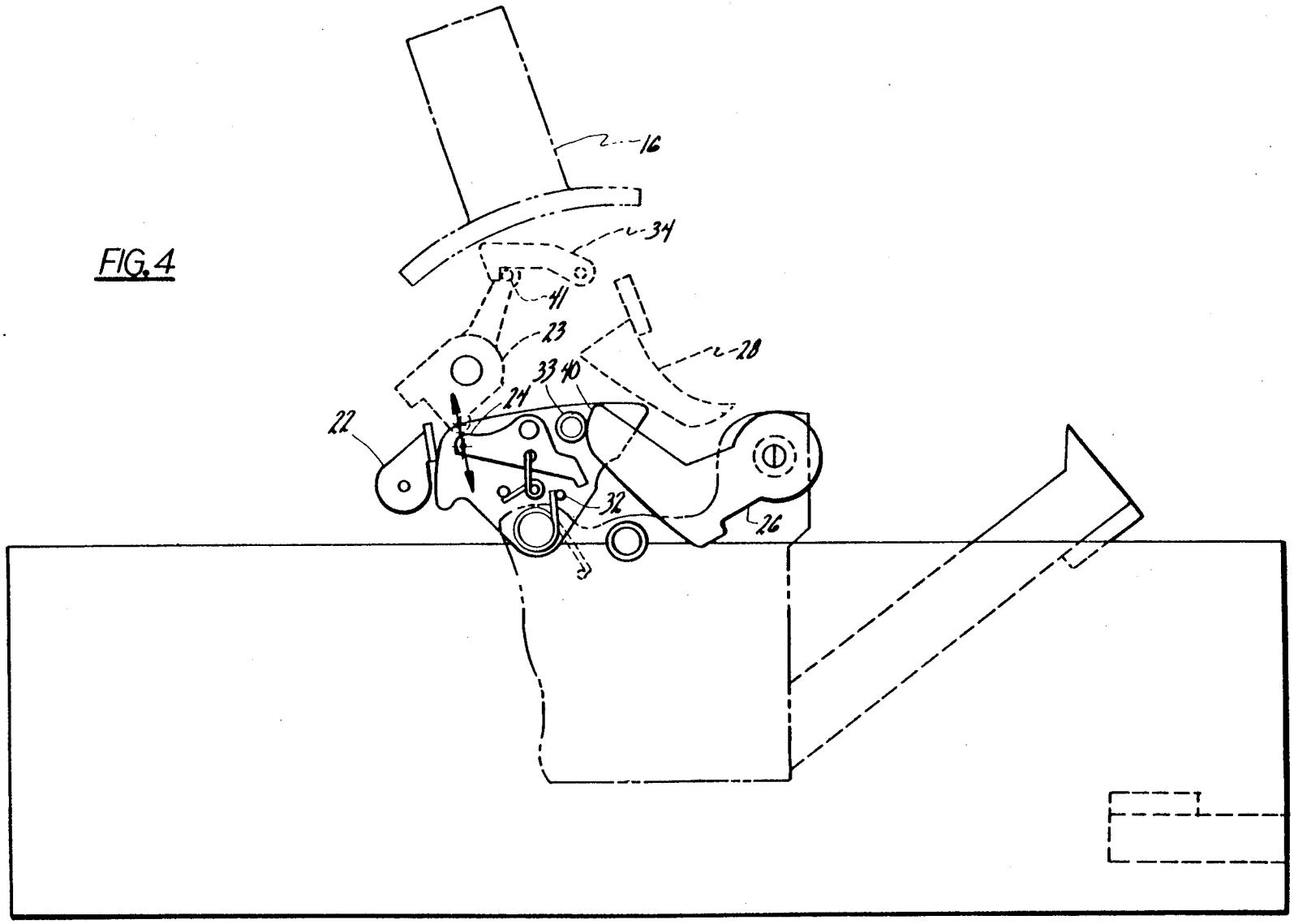
FIG. 4 is a cutaway side view of the circuit interrupter of FIG. 1 with the operating mechanism in the secondary reset stage.

In the primary reset stage indicated in FIG. 3, the line of action between the reset bar 24 and trip cam 23 is in the direction indicated by the arrows thereby holding the reset bar against stop pin 32 and forcing the trip cam 23 to rotate clockwise about pivot pin 42 under the actuator-accessory latch 34. Further rotation of the operating handle 16 in the counterclockwise direction to the secondary reset position shown in FIG. 4 positions the trip cam 23 under the actuator-accessory latch 34. The actuator-accessory latch engages the latch pin 41 on the trip cam 23 only when the actuator-accessory unit is in its reset condition. The cam-shaped end 40 of the sequence driver 26 contacts the drive roller 33 and moves the reset bar 24 to the bypass position indicated in FIG. 4 off the stop pin 32 such that the new indicated line of action between the reset bar and trip cam allows the reset bar to rotate past the projection on the trip cam and accordingly become disengaged from the trip cam. Additional rotation of handle 16 allows the cradle 28 to rotate to its latched position. In the event that the actuator-accessory unit is unable to become reset due to an undervoltage condition, for example, the actuator-accessory latch 34 would immediately release the trip cam 23 which thereby contacts the trip bar 22 to articulate the operating mechanism and return the operating mechanism to the TRIPPED position shown in FIG. 2.

Figure 5:
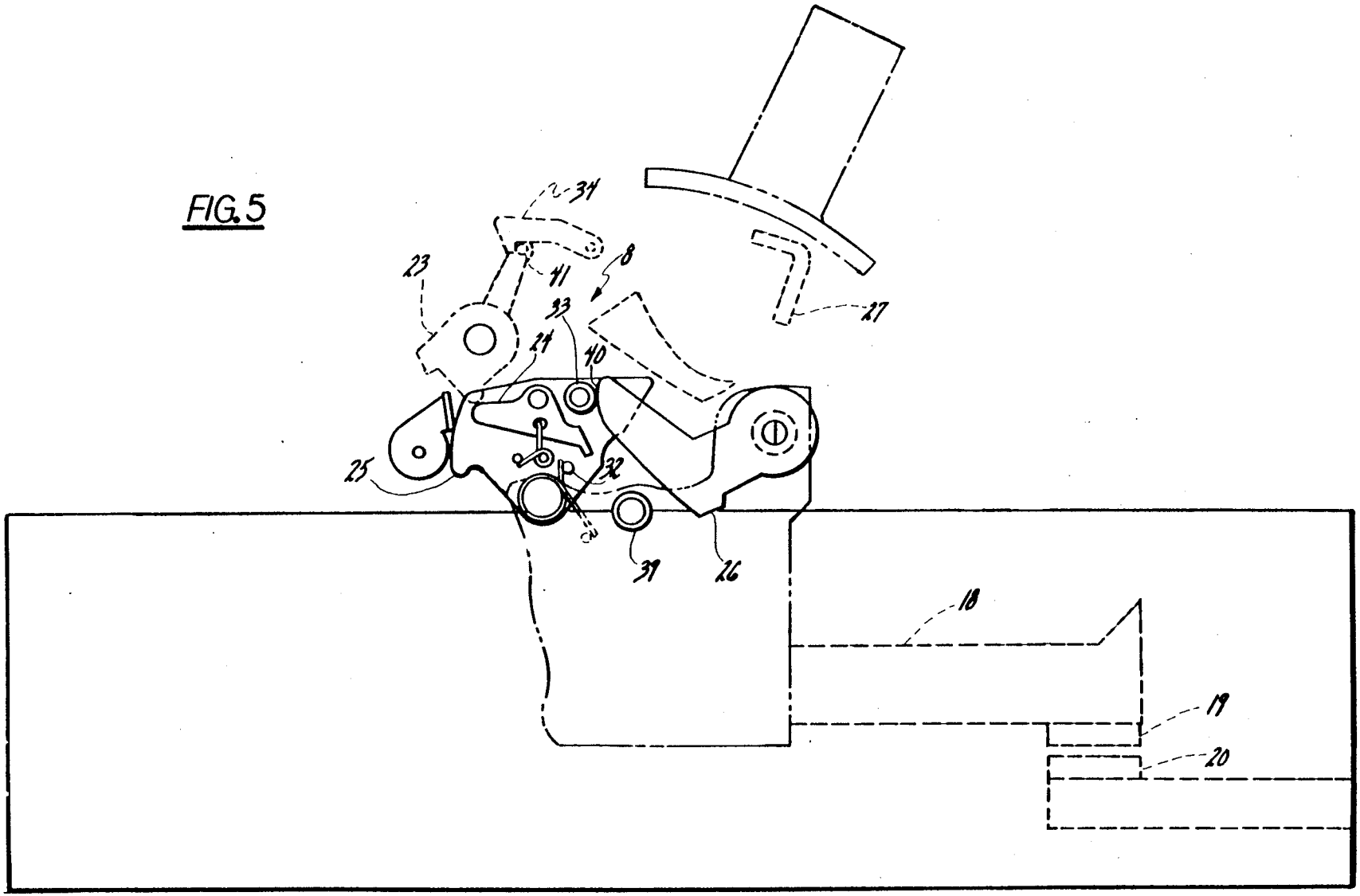
FIG. 5 is a cutaway side view of the circuit interrupter of FIG. 1 with the operating mechanism in a "CLOSED" condition.

When the actuator-accessory unit and the operating mechanism are both reset, the latch pin 41 on the trip cam 23 becomes retained by the actuator-accessory latch 34, and the operating handle 16 is rotated in the clockwise direction to drive the handle yoke 27 and associated movable contact arm 18 to the CLOSED position depicted in FIG. 5 with the contacts 19, 20 in abutment with each other. The sequential resetting system 8 remains in the secondary reset position shown earlier in FIG. 4 with the cam-shaped surface 40 of the sequence driver 26 in contact with the drive roller 33, the reset bar 24 in its bypass position away from stop pin 32 and with the sequence lever 25 away from the stop post 39. The cam surface 40 on the end of the sequence driver takes up all the tolerances existing between the various components of the operating mechanism and the sequential resetting system.

The sequential resetting arrangement of the invention is directed to be used with circuit interrupters that include electronic trip units for automatic interruption of circuit current in order to reset the actuator-accessory unit. The resetting arrangement also serves to reset auxiliary devices that are not part of the actuator-accessory unit such as when used within electric switches.

One example of such an electric switch is found in U.S. Pat. No. 4,778,995, which Patent is incorporated herein for reference purposes. When accessory devices, per se, are used with such switches, actuators are not required and the accessory devices themselves must be reset before the switch is turned from its OFF to its ON condition. It is, accordingly, within the scope of this invention to use the resetting arrangement described herein for accessory devices within such electric switches.

A sequential resetting arrangement has herein been described whereby means are provided for insuring that the accessory or actuator-accessory is in a reset condition before the circuit breaker operating mechanism can be reset to its operating condition or before the electric switch is turned to its ON condition.

Having thus described our invention, what we claim as new and desire to secure by Letters Patent is:

1. A molded case circuit interrupter or electric switch comprising:

a plastic interrupter case and cover;

an actuator unit or accessory unit within said interrupter cover;

an operating mechanism contained between a pair of opposing sideframes within said interrupter case and arranged for separating a pair of contacts;

an externally accessible operating handle connecting with said operating mechanism through a handle yoke arrangement for moving said operating mechanism between CLOSED and OPEN positions;

a sequential resetting arrangement intermediate said actuator unit or accessory unit and said operating mechanism for resetting said actuator unit or accessory unit before latching said operating mechanism, said sequential resetting arrangement including a sequence driver connected to a cradle pivot pin within said operating mechanism, a sequence lever pivotally attached to one of said sideframes intermediate said sequence driver lever and a trip cam on said actuator unit; and an actuator latch on said actuator unit arranged for capturing a latch pin on said trip cam and thereby latch said actuator unit when said actuator unit is electrically energized.

2. The circuit interrupter of claim 1 wherein said sequence lever is biased to a rest position against a stop pin on said one sideframe by means of a first spring.

3. The circuit interrupter of claim 1 including a drive roller on said sequence lever abutting said sequence driver lever.

4. The circuit interrupter of claim 3 wherein said driver lever comprise an L-shaped configuration having a first part and a second part, said first part abutting said driver roller and said second part being attached to said cradle pivot.

5. The circuit interrupter of claim 1 wherein said trip cam is pivotally arranged within said circuit interrupter cover by means of a pivot pin.

6. A molded case circuit interrupter or electric switch comprising:

a plastic interrupter case and cover;

an actuator unit or accessory unit within said interrupter cover;

an operating mechanism contained between a pair of opposing sideframes within said interrupter case and arranged for separating a pair of contacts;

an externally accessible operating handle connecting with said operating mechanism through a handle yoke arrangement for moving said operating mechanism between CLOSED and OPEN positions; and a sequential resetting arrangement intermediate said actuator unit or accessory unit and said operating mechanism for resetting said actuator unit or accessory unit before latching said operating mechanism, said sequential resetting arrangement including a sequence driver connected to a cradle pivot pin within said operating mechanism, a sequence lever pivotally attached to one of said sideframes intermediate said sequence driver lever and a trip cam on said actuator unit, a reset bar pivotally attached to said sequence lever and biased at one end against a stop pin on said sequence lever by a second spring, whereby an opposite end of said reset bar contacts a projection on said trip cam and thereby generates a line-of-action through said opposite end of said reset bar and said projection when said sequence lever is rotated by said sequence driver to rotate said trip cam into latching arrangement with said actuator latch.

7. The circuit interrupter of claim 6 whereby further rotation of said sequence driver rotates said reset bar out of contact with said trip cam.

8. The circuit interrupter of claim 7 whereby said reset bar rotates back to said rest position under the return bias of said second spring when said trip cam rotates away from said trip cam.

9. The circuit interrupter of claim 4 wherein said first part includes a cam-shaped surface for engaging said drive roller and providing tolerance compensation between said operating mechanism and said sequential resetting arrangement.

* * * * *